US010145058B2

(12) United States Patent
Heinz et al.

(10) Patent No.: US 10,145,058 B2
(45) Date of Patent: Dec. 4, 2018

(54) METHOD AND DEVICE FOR IRONING ITEMS OF LAUNDRY

(71) Applicant: Herbert Kannegiesser GmbH, Vlotho (DE)

(72) Inventors: Engelbert Heinz, Vlotho (DE); Wilhelm Bringewatt, Porta Westfalica (DE)

(73) Assignee: Herbert Kannegiesser GmbH, Vlotho (DE)

( * ) Notice: Subject to any disclaimer, the term of this patent is extended or adjusted under 35 U.S.C. 154(b) by 88 days.

(21) Appl. No.: 14/987,282

(22) Filed: Jan. 4, 2016

(65) Prior Publication Data

US 2016/0215439 A1 Jul. 28, 2016

(30) Foreign Application Priority Data

Jan. 27, 2015 (DE) ..... 10 2015 000 844
Sep. 24, 2015 (DE) ..... 10 2015 012 404

(51) Int. Cl.
*D06F 67/04* (2006.01)
*D06F 67/02* (2006.01)
*D06F 69/02* (2006.01)

(52) U.S. Cl.
CPC ..... *D06F 67/04* (2013.01); *D06F 67/02* (2013.01); *D06F 69/02* (2013.01)

(58) Field of Classification Search
CPC ..... D06F 67/00–67/10; D06F 69/02
See application file for complete search history.

(56) References Cited

U.S. PATENT DOCUMENTS 1,107,737 A * 8/1914 Witham et al. ..... D21G 9/0036 144/255
1,118,712 A * 11/1914 Wendell ..... D06F 61/08 38/49

(Continued)

FOREIGN PATENT DOCUMENTS

DE 186629 C 6/1906
DE 3209478 A1 1/1983

(Continued)

OTHER PUBLICATIONS

European Patent Office, Europaischer Recherchenbericht (search on related application), dated Jun. 29, 2016.

(Continued)

*Primary Examiner* — Ismael Izaguirre
(74) *Attorney, Agent, or Firm* — Laurence P. Colton; Smith Tempel Blaha LLC

(57) ABSTRACT

In band ironers, laundry items are moved along a pressing surface of a stationary ironer roller by an ironer band that entrains the laundry items, wherein the laundry items slide with slip along a lateral surface of the ironer roller. As the speed of the ironer increases, slip between the laundry items and the lateral surface of the ironer roller increases. When the desired ironing quality makes less slip necessary, the circumferential speed of the ironer band has to be reduced, and the throughput of the band ironer suffers. The invention is to drive the ironer roller in a circumferential manner wherein the slip between the ironer roller and the laundry items is adjusted in an arbitrary manner as a result of adjusting the rotational speed of the drive of the ironer roller and/or the circumferential speed of the ironer band without reducing the throughput of the band ironer.

26 Claims, 9 Drawing Sheets

(56) References Cited

U.S. PATENT DOCUMENTS

| | | | | | |
|---|---|---|---|---|---|
| 1,552,496 | A * | 9/1925 | Murphy, Sr. | D06F 67/00 | 118/231 |
| 3,510,971 | A | 5/1970 | Bravetti | | |
| 3,634,956 | A | 1/1972 | Behn | | |
| 3,643,344 | A * | 2/1972 | Strube | F26B 13/183 | 165/89 |
| 3,868,780 | A * | 3/1975 | Soininen | D21F 5/02 | 34/116 |
| 4,128,953 | A * | 12/1978 | Geiger | D06F 65/02 | 38/56 |
| 4,197,663 | A * | 4/1980 | Riedel | D06B 23/04 | 38/11 |
| 4,296,514 | A * | 10/1981 | Dokoupil | A43D 25/00 | 12/1 A |
| 4,418,486 | A * | 12/1983 | Kober | D06F 67/02 | 38/44 |
| 4,599,814 | A * | 7/1986 | Geiger | D06B 15/04 | 34/86 |
| 4,781,795 | A * | 11/1988 | Miller | B30B 5/04 | 100/153 |
| 5,906,061 | A | 5/1999 | Adler | | |
| 5,933,988 | A * | 8/1999 | Adler | D06F 67/02 | 100/92 |
| 7,578,082 | B2 * | 8/2009 | Sans Rovira | D06F 69/02 | 38/44 |

FOREIGN PATENT DOCUMENTS

| | | | |
|---|---|---|---|
| DE | 3209404 | A1 | 2/1983 |
| DE | 4410588 | A1 | 9/1995 |
| DE | 102012108921 | A1 | 5/2013 |
| EP | 0078528 | A2 | 5/1983 |
| EP | 0233320 | A1 | 8/1987 |
| EP | 0233320 | B1 | 8/1987 |
| EP | 1308551 | A1 | 5/2003 |
| EP | 2034087 | A1 | 3/2009 |
| EP | 2716812 | A1 | 4/2014 |
| FR | 630448 | A | 12/1927 |
| FR | 727214 | A | 6/1932 |
| FR | 1085615 | A | 2/1955 |
| FR | 1385543 | A | 1/1965 |
| FR | 1394281 | A | 4/1965 |
| FR | 1544981 | A | 11/1968 |
| FR | 2094357 | A5 | 2/1972 |
| GB | 2073272 | A | 10/1981 |
| GB | 2102030 | A | 1/1983 |

OTHER PUBLICATIONS

Deutsches Patent—Und Markenamt (German Patent and Trademark Office), Recherchebericht (Search in connection with a priority application), dated Jul. 16, 2015.

European Patent Office, Europaischer Teilrecherchenbericht (European search report on a related application), dated Mar. 11, 2016.

* cited by examiner

METHOD AND DEVICE FOR IRONING ITEMS OF LAUNDRY

STATEMENT OF RELATED APPLICATIONS

This application claims the benefit of and priority on German Patent Application No. 10 2015 000 844.7 having a filing date of 27 Jan. 2015 and German Patent Application No. 10 2015 012 404.8 having a filing date of 24 Sep. 2015

BACKGROUND OF THE INVENTION

Technical Field

The invention relates to methods for ironing items of laundry, namely a method for ironing items of laundry, wherein the items of laundry are conveyed through an ironer gap between at least one ironer body and at least one circumferentially driven ironer band and are at the same time smoothed out, or a method for ironing items of laundry, wherein the laundry items are conveyed through an ironer gap between at least one ironer body and at least one ironer band and a lateral surface of at least one ironer body is heated with steam. The invention also relates to devices for ironing items of laundry, namely a device for ironing items of laundry, said device having at least one ironer body and at least one ironer band which is associated with the at least one ironer body and is circumferentially drivable, wherein the laundry items are conveyable through an ironer gap between the or the respective ironer body and the ironer band, or through an ironer gap between the or the respective ironer body and the ironer band associated with the same.

Prior Art

The ironing of all kinds of laundry items in both industrial laundries and in the household is effected using various devices. So-called chest ironers with at least one rotatingly drivable ironer roller and one semi-circular, heatable ironer chest associated with said ironer roller are used predominantly in domestic and industrial situations. Devices usually designated as band ironers which comprise at least one ironer body and at least one circumferentially drivable ironer band which is associated with the ironer body are also used.

The invention relates to band ironers. In the case of known devices of this type, the laundry items to be treated are moved along the stationary ironer body by the circumferentially driven ironer band. At the same time there is slip between the laundry item and the stationary ironer body. This leads to a smooth finish on the side of the laundry item abutting against the ironer body. The degree of gloss or the degree of smoothness of the finish can be influenced by adjusting the slip. If only a weak finish is desired, the slip has to be reduced, which can only be realized in the case of the known band ironers by reducing the circumferential speed of the ironer band. This reduces the ironer output. A further problem in the case of known band ironers is the heating of the lateral surface of the ironer body that comes into contact with the laundry items and forms a pressing surface. The feeding of the laundry items in the inlet region of the ironer gap is also a problem in the case of the known band ironers. The diverting of the ironed laundry items out of the outlet region of the ironer gap can also cause problems in the case of known band ironers.

BRIEF SUMMARY OF THE INVENTION

The object underlying the invention is to create methods and devices which allow the finish-treatment of the laundry items to meet the requirements and the ironing to be economic and fault-free.

A first method for achieving said object comprises a method for ironing items of laundry, wherein the items of laundry are conveyed through an ironer gap between at least one ironer body and at least one circumferentially driven ironer band and are at the same time smoothed out, characterized in that an ironer roller, which is also circumferentially driven, serves as an ironer body, the at least one ironer roller as well as the at least one ironer band are circumferentially driven in such a manner that a relative movement between the at least one ironer roller and the at least one ironer band is generated along the ironer gap. It is provided according to said method also to drive the at least one ironer body in a circumferential manner by realizing the same as an ironer roller and to drive the at least one ironer roller as well as the at least one circumferentially driven ironer band in such a manner that a targeted relative movement between the at least one ironer roller and the at least one ironer band is generated.

It is provided in a preferred manner, that by adjusting the drive speed or rotational speed of the ironer roller or of the ironer band, where applicable, however, possibly also adjusting the drive speed of both the at least one ironer roller and the at least one ironer band, the relative speed between the respective ironer roller and the respective ironer band is able to be adjusted in the desired manner. As a result, the slip on the side of the respective laundry item pointing to the ironer roller and consequently the finish on said side of the laundry item can be adjusted in an arbitrary manner, in particular steplessly, corresponding to the requirements.

In a preferred manner, by adjusting the scope of the relative movement between the at least one ironer roller and the at least one ironer band, the slip between the laundry item, in particular the side of the same abutting against the ironer roller, with respect to the respective ironer roller is enlarged or reduced or, where applicable also momentarily completely eliminated, corresponding to the requirements. Said slip is able to be generated as a result of a lower or higher circumferential speed of the respective ironer roller in relation to the respective ironer band.

Another development option of the method provides that the slip of the laundry item in relation to the at least one ironer roller, in particular to the outside circumference of the pressing surface formed by the same, is generated by a drive of the at least one ironer roller which rotates slower in relation to the at least one ironer band which entrains the laundry item in a slip-free manner. As a result, the circumferential speed of the respective ironer roller is lower than the speed at which the laundry item, entrained in a slip-free manner by the respective ironer band, is moved along the ironer roller or its pressing surface.

A first device for achieving the object named in the introduction is a device for ironing items of laundry, said device having at least one ironer body and at least one ironer band which is associated with the at least one ironer body and is circumferentially drivable, wherein the laundry items are conveyable through an ironer gap between the or the respective ironer body and the ironer band, characterized in that the or each ironer body is realized as an ironer roller, the at least one ironer roller is also circumferentially drivable and the at least one ironer roller and the at least one ironer band are drivable in such a manner that they comprise a relative movement with respect to one another along the ironer gap. Accordingly, the at least one ironer body is realized as a circumferentially, rotatingly drivable ironer roller. The at least one ironer roller and the at least one ironer band, in this case, are drivable in such a manner that they run at different speeds along the ironer gap and as a result generate a relative movement with respect to one another.

The relative movement can preferably be generated by a drive of the respective ironer roller at an adjustable rotational speed, whilst the respective ironer band is driven at a constant rotational speed. It is also conceivable, however, to drive the ironer roller at a constant speed and instead to realize the drive of the respective ironer band such that the circumferential speed of the ironer band is adjustable. It is also conceivable to provide both the ironer roller and the ironer band with drives of adjustable speed and/or rotational speed. As a result of the adjustable speeds or rotational speeds of the at least one ironer roller and/or of the at least one ironer band, the slip between the respective ironer roller and the ironer band associated therewith can be adjusted, preferably in a stepless and/or arbitrary manner. As a result, the finish of the side of the laundry item associated with the ironer roller is variable, in particular adjustable corresponding to the requirements.

It is provided in a preferred manner to drive the at least one ironer roller in such a manner that the circumferential speed on the outside on the lateral surface of the respective ironer roller is faster or slower than the speed at which the at least one ironer band runs along the ironer gap or the at least one ironer roller. As a result, the slip between the lateral surface of the respective ironer roller and the ironer band or the laundry item associated therewith is adjustable in an arbitrary manner by the lateral surface of the respective ironer roller. Said slip can be negative or positive, that means that the respective ironer roller can be faster or even slower than the relevant ironer band or the laundry item entrained by the same in a slip-free manner. In this way, the throughput speed of the laundry item through the ironer gap of the band ironer can be maximum and nevertheless the slip between the ironer band and the ironer roller or the ironer roller and the laundry item entrained in a slip-free manner by the ironer band can be adjusted corresponding to the requirements.

An advantageous development option of the device provides realizing the outside surface of the lateral surface, that is to say the pressing surface, of the at least one ironer roller in a smoother manner than the surface of the at least one ironer band which comes into contact with the laundry item. This ensures that the respective laundry item is entrained in a slip-free manner by the relevant ironer band and that there is only slip between the side of the laundry item associated with the pressing surface of the ironer roller with respect to the ironer roller. For this purpose the pressing surface of the at least one ironer roller has low-adhering properties and is therefore realized in a relatively smooth manner. This can be realized in a different way, for example by means of a coating which realizes a smooth, low-adhering surface, produced, for example, from plastics material such as, for example, Teflon® brand of polymers, ceramic or chromium-plate. In contrast, the adhering properties of the at least one ironer band, at least the side of the same coming into contact with the laundry item, are produced by a rough woven fabric or a roughening of the ironer band or of at least the top surface of the same such that it obtains adhering properties, as a result of which the laundry item is entrainable in a reliable and slip-free manner by the respective ironer band.

A further method for achieving the object named in the introduction comprises a method for ironing items of laundry, wherein the laundry items are conveyed through an ironer gap between at least one ironer body and at least one ironer band and a lateral surface of at least one ironer body is heated with steam, characterized in that the lateral surface of the at least one ironer body or the lateral surfaces of several consecutive ironer bodies is or are heated with steam with a variable energy content. In this connection, this can also be a preferred further development of the previously described method. This method is characterized in that the lateral surface of the at least one ironer body is heated with steam with variable energy content and/or variable energy density. As a result, the entire lateral surface of each ironer body does not need to be heated with steam with a maximum energy density, for example saturated steam or hot steam. Thus, cooled or already expanded steam can also be used to heat another part of the respective ironer body or another ironer body. As a result of this method of operation, the energy of the steam can be used to the greatest possible extent to heat the respective ironer body.

It is provided in a preferred manner that part of the lateral surface of at least one ironer body is heated with steam comprising a greater energy content than at least the other part of the ironer body. Thus, it is possible to heat the part of the ironer body from which more energy is removed when ironing the laundry item in a more intense manner than a remaining part of the ironer body where not so much energy is required. A part of the at least one ironer body proceeding from an inlet side into the ironer gap is preferably heated with steam with a greater energy content than a part of the same ironer body proceeding from the oppositely situated outlet side of the ironer gap. In a preferred manner, different steam types are usable in this way in order to heat the one or at least another part of the respective ironer body, in particular the pressing surface thereof, in an appropriate manner. In a preferred manner, with reference to the pressing surface proceeding from the inlet region, the initial part of the pressing surface is heated with steam comprising a greater energy density than another part of the pressing surface at least following thereafter when viewed in the throughput direction of the laundry items through the ironer gap, preferably a part of the ironer body which extends up to the end of the pressing surface in the outlet region.

According to an advantageous further development of the method, it is provided to use live steam, preferably saturated steam or hot steam, as steam with a greater energy content or greater energy density, and already expanded steam, preferably so-called flash steam, as steam with a smaller energy content or lesser energy density. Expanded steam is in particular steam used to heat the initial part of the ironer body. Said steam is expanded outside the ironer body and is consequently prepared again as it were so that it is suitable for heating at least one rear part of the ironer body. Thus, the maximum possible energy can be removed from the steam for heating the respective ironer body.

It is also conceivable in the case of devices with several consecutive ironer bodies to heat the entire first ironer body with steam with a greater energy content or greater energy density and at least one entire subsequent ironer body with already expanded steam from the first ironer body, that is to say steam with a lesser energy content or lesser energy density.

A preferred development variant of the method provides that the steam with greater energy content or greater energy density, in particular live or saturated steam, is removed from the heated first part of the lateral surface of at least one ironer body or an initial ironer body and is subject to an expansion or re-evaporation. The expanded steam generated in this case, so-called flash steam, is then fed again either to the other part of the same ironer body, preferably close to the outlet region, or to another subsequent ironer body. In this way, in a quasi cascade-like manner, the steam is expanded once or, where applicable, several times for heating different parts of the same ironer body or different consecutive ironer bodies. The energy of the steam, in this case, is made use of for the most part. This results in one or also several ironer bodies being heated in a particularly economic manner.

A further device for achieving the object named in the introduction comprises a device for ironing items of laundry, said device having at least one ironer body and at least one ironer band which is associated with the at least one ironer body and is circumferentially drivable, wherein the items of laundry are conveyable through an ironer gap between the or the respective ironer body and the ironer band associated with the same, characterized in that the lateral surface of at least one ironer body, defining the ironer gap on one side, has associated therewith two separate cavities, which follow one after the other in the longitudinal direction of the ironer gap, for heat carriers for heating the ironer body or, in the case of several consecutive ironer bodies, the cavities of the individual ironer bodies are suppliable with steam with a variable energy content. Said device can also be a preferred further development of the previously described device. In the case of this device, it is provided for the lateral surface defining the ironer gap of at least one ironer body to have associated therewith at least two separate cavities, which are consecutive in the longitudinal direction of the ironer gap, for heat carriers for heating the ironer body. Accordingly, in an initial region of the ironer gap the lateral surface of the at least one ironer body can be heated with a certain energy density with a heat carrier which flows through said cavity and at least one region of the ironer gap following thereafter can be heated in another separate cavity of the ironer body with another heat carrier or a heat carrier which comprises a lower energy density. The separate cavities of the respective ironer body following one after another in the ironing direction allow for selective heating of ironer gap. This can occur with different heat carriers, but also with the same heat carrier from which part of the energy has already been removed in the preceding cavity for heating the part of the lateral surface of the ironer body associated therewith. Thus it is possible, making the greatest possible use of the energy in the heat carrier, preferably steam, to heat the pressing surface of the ironing body defining the ironer gap in an individual manner.

In a preferred manner, each cavity in the relevant ironer body is provided with at least one feed connection for feeding the heat carrier and at least one discharge connection for discharging the heat carrier. In this case, the feed connections are associated with a top region of the respective ironer body and the discharge connections with a bottom region of a respective ironer body. Associating the discharge connections in the bottom region of the ironer body makes it possible to discharge the steam utilized for heating together with condensate out of the respective cavity in the ironer body.

A further development option of the device provides associating a pipe which leads to a condensate separator and/or an expansion device with a discharge connection of a cavity which is traversed by hot steam or saturated steam, and associating a pipe for feeding expanded steam or flash steam to another cavity of the same ironer body or to another subsequent ironer body with the condensate separator or the expansion device.

In a preferred manner, it is provided that at least one cavity for live steam, in particular saturated steam or hot steam, has associated therewith a front part of the lateral surface of the ironer body which proceeds from the inlet region, whilst at least one cavity, separated therefrom, for expanded or flash steam is associated with a rear part of the lateral surface of the same ironer body which proceeds from the outlet region. In this way, the already expanded steam, which comprises less energy, is usable in a targeted manner at locations where the laundry has already been dried and ironed for the most part, whilst a large part of the energy is feedable to the laundry that is still moist and non-ironed in the inlet region.

As an alternative to this, it is conceivable in the case of devices with several consecutive ironer bodies, past which each item of laundry runs one after another, to heat the first ironer body completely with steam with a greater energy density, in particular live steam, and to heat the following ironer body with steam, from which part of the energy has been removed after running through a condensate separator and/or an expansion device. As a result, the subsequent ironer body is heated by the steam which has already been used to heat the preceding ironer body.

A further device for achieving the object named in the introduction comprises a device for ironing items of laundry, said device having at least one ironer body and at least one ironer band which is associated with the at least one ironer body and is circumferentially drivable, wherein the items of laundry are conveyable through an ironer gap between the or the respective ironer body and the ironer band associated with the same, characterized in that at least one inlet region of the laundry items into the respective ironer gap has associated therewith a feeding aid, the start of which in front of the inlet region is held at a spacing from the ironer band and the feeding aid projects into the ironer gap by way of a free end located opposite the start. In this connection, these can also be preferred further developments of the previously described devices. In the case of this device, it is provided associating a feeding aid, the start of which is held at a spacing from the ironer band and the free rear end of which, located opposite the start, extends into the ironer gap, with at least one inlet region of the respective laundry item into the ironer gap. The feeding aid consequently overlaps the ironer band in the inlet region such that a type of sandwich conveyor is created with two parallel runs. The respective laundry item is conveyed into the inlet region in a crease-free manner between said runs, namely the ironer band and the feeding aid.

In a preferred manner, the respective feeding aid is formed as a soft, flexible material strip or a flexible material web. It is preferably a material strip or a material web with good sliding properties. Thus, when the laundry item is introduced into the inlet region, the laundry item can be moved along between the driven ironer band entraining it and the stationary feeding aid located in the inlet region so that the laundry item is conveyed into the ironer gap in a reliable manner.

A preferred development option of the device provides fixing a front end, located just before the inlet region, in particular a front transverse edge, of the material strip or of the flexible, soft material web in a stationary manner at a small spacing above the ironer band. A type of feed funnel for feeding the laundry item, which is enclosed between the ironer band and the material strip or the material web, to the inlet region and start of the ironer gap is created as a result. In this way, a type of sandwich is created in which the laundry item, guided in a crease-free manner, is entrainable by the ironer band until reaching the start of the ironer gap.

A further device for achieving the object named in the introduction comprises a device for ironing items of laundry, said device having at least one ironer body and at least one ironer band which is associated with the at least one ironer body and is circumferentially drivable, wherein the items of laundry are conveyable through an ironer gap between the or the respective ironer body and the ironer band associated with the same, characterized in that at least one outlet region of the or of the respective ironer gap has associated therewith at least one discharging aid for laundry items that have been ironed. In this connection, this can be a preferred further development of the previously described devices. In the case of this device, it is provided associating at least one discharging aid for laundry items that have been ironed with the outlet region of the or of the respective ironer body and the associated ironer gap. The respective discharging aid serves for the purpose of discharging or separating the ironed laundry items from the ironer body and/or the ironer band when they leave the ironer gap. However, the respective discharging aid also serves for the purpose of directing the ironed laundry items in a reliable and above all crease-free manner to a removal conveyor which connects to the outlet region or into the inlet region of a subsequent ironer body. A discharging aid can also be formed, as the previously described feeding aid, by a flexible material strip. It is also conceivable to form the discharging aid or aids from a thin-walled material strip, preferably a flexible metal strip. In a preferred manner, the material or metal strip is to be fixed at the end of the ironer gap with a front transverse edge on the preferably stationary, that is non-rotatingly driven ironer body. As a result, in the outlet region the respectively ironed laundry item is able to be conveyed away from the outlet region in a reliable and crease-free manner under the influence of the material or metal strip.

A discharging aid can only be associated with one side or surface of the laundry items. Preferably, however, both oppositely situated sides or surfaces of the laundry items have in each case a discharging aid associated therewith. The laundry items, guided on both sides by the discharging aids, are then directed away from the outlet region and at a certain position are directed to a subsequent conveyor.

It is preferably provided associating at least one discharging means with a side or surface, preferably the bottom surface, of the laundry item coming into contact with the ironer band. The laundry item can then be directed to a subsequent conveyor and/or transferred to the subsequent conveyor by or on said discharging means. Said discharging means can be realized in various ways. For example, the discharging means associated with the bottom side of the laundry items can be a scraper or a baffle plate for mechanically guiding the ironed laundry items or can be formed by preferably several air nozzles for discharging the laundry items from the outlet region in a pneumatically guided manner. It is also conceivable for the discharging means associated with the bottom surface of the laundry items to be formed by preferably several brushes in, particular rotating brushes, which are arranged next to one another. The brushes, but also the other conceivable discharging means, serve above all for the purpose of detaching or separating the ironed laundry items, which abut against the ironer band with their bottom surfaces, from the ironer band in the outlet region before the laundry items are directed by the discharging means to the following conveyor and/or are carried or guided on the way to there.

According to an advantageous development option of the device, at least the surfaces of the material strip or of the material web which come into contact with the laundry items of both the feeding aid and the discharging aid are provided with good sliding properties and/or are realized in a non-adhering manner, for example as a result of a coating produced from Teflon® brand of polymers. As a result, the laundry items are able to slide without a large amount of resistance along the surface of the material web or of the material strip that comes into contact with them when the laundry items, entrained by the ironer band, are fed under and/or beyond the material web or the material strip to the ironer gap or are conveyed away out of the ironer gap, although the material strip or the material web are preferably not entrained at the same time.

In a preferred manner, it is additionally provided to provide the outer lateral surface which comes into contact with the laundry item, in particular the pressing surface, of the at least one ironer body or of the ironer roller with non-adhering properties. In a preferred manner, the pressing surface of the ironer body or of the ironer roller is realized in a smooth manner so that the pressing surface comprises as small a coefficient of friction as possible. The outer lateral surface of each ironer body or of each ironer roller is preferably provided with a wear-proof anti-adherent coating which is formed, for example, from plastics material that comprises good sliding properties such as Teflon® brand of polymers or ceramic or chromium-plate. In contrast, the or each ironer band is developed such that at least the side of the same that comes into contact with the laundry item comprises adhering properties by being, for example, rough or roughened and/or comprising adhesive properties on the surface. This ensures that the laundry item is reliably entrained by the circumferentially driven ironer band, but is able to slide along the pressing surface of the ironer body or of the ironer roller with minimal resistance.

BRIEF DESCRIPTION OF THE DRAWINGS

Preferred exemplary embodiments of the invention are explained in more detail below by way of the drawing, in which.

DETAILED DESCRIPTION OF PREFERRED EMBODIMENTS

Figure 2:
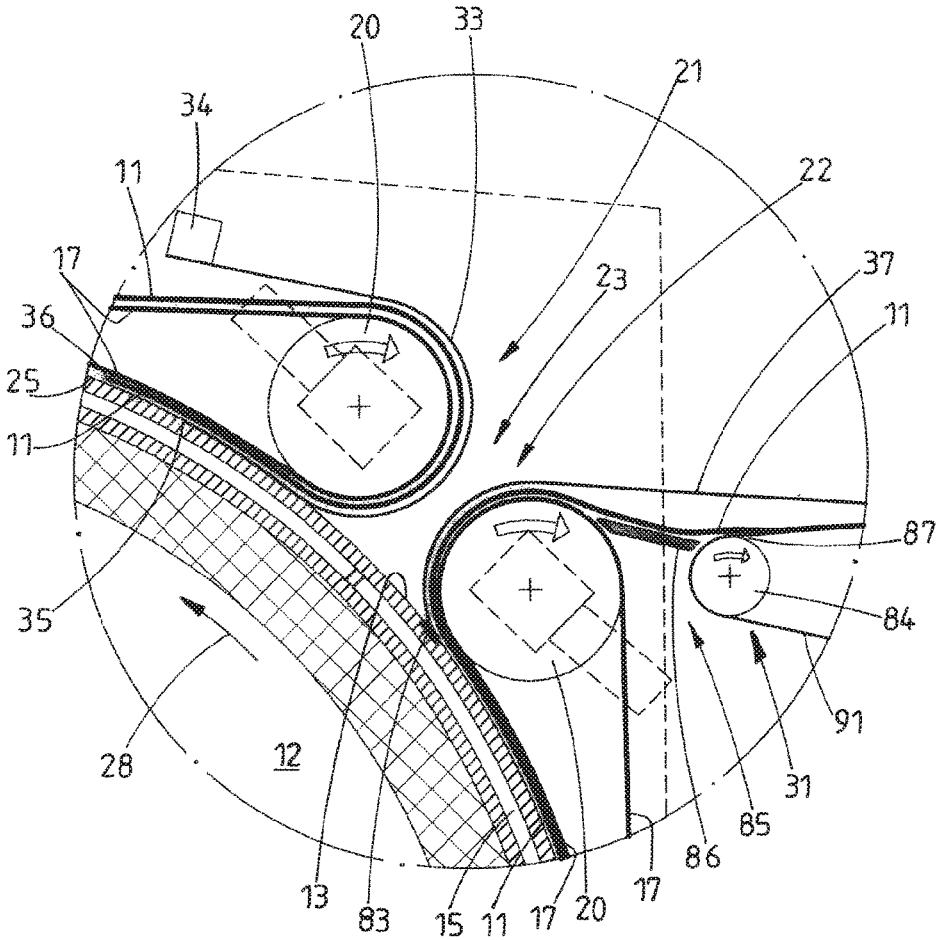
FIG. 2 shows an enlarged detail II from FIG. 1.
Figure 3:
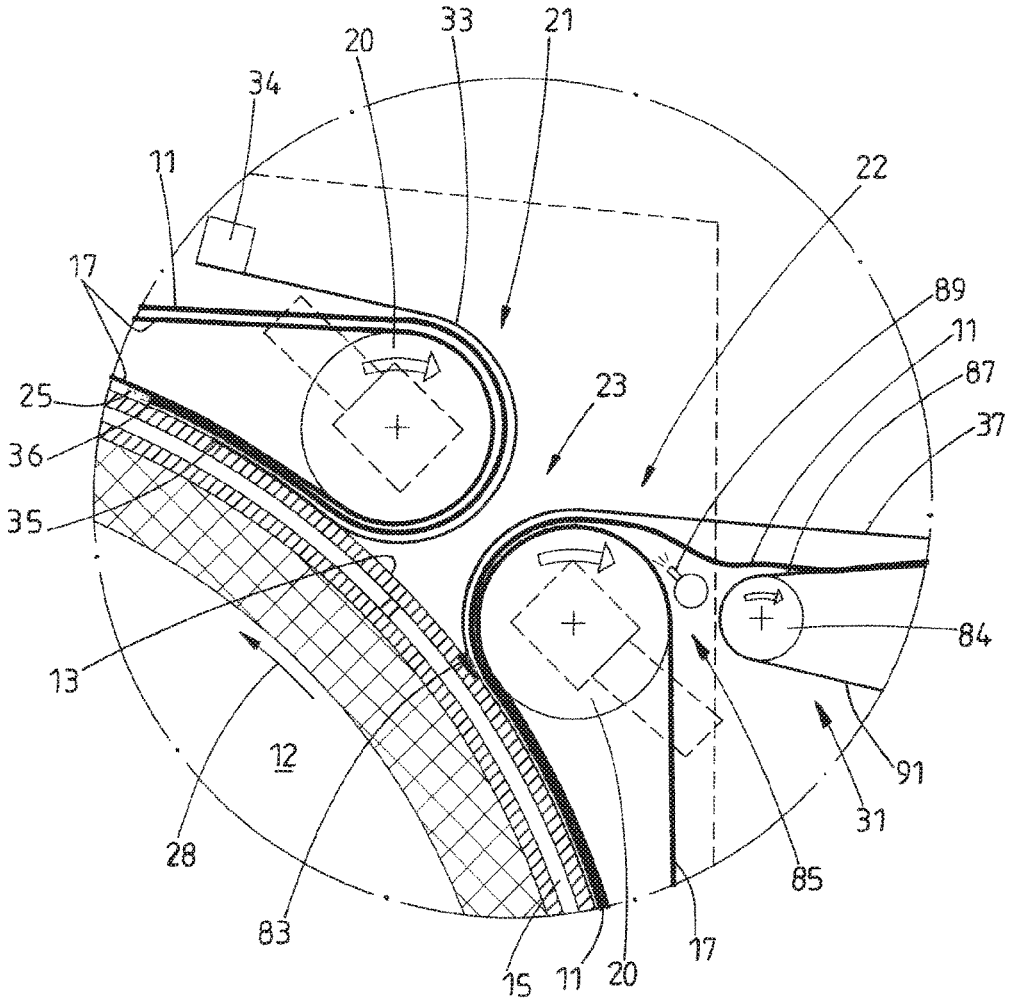
FIG. 3 shows the detail of FIG. 2 for an alternative exemplary embodiment.
Figure 4:
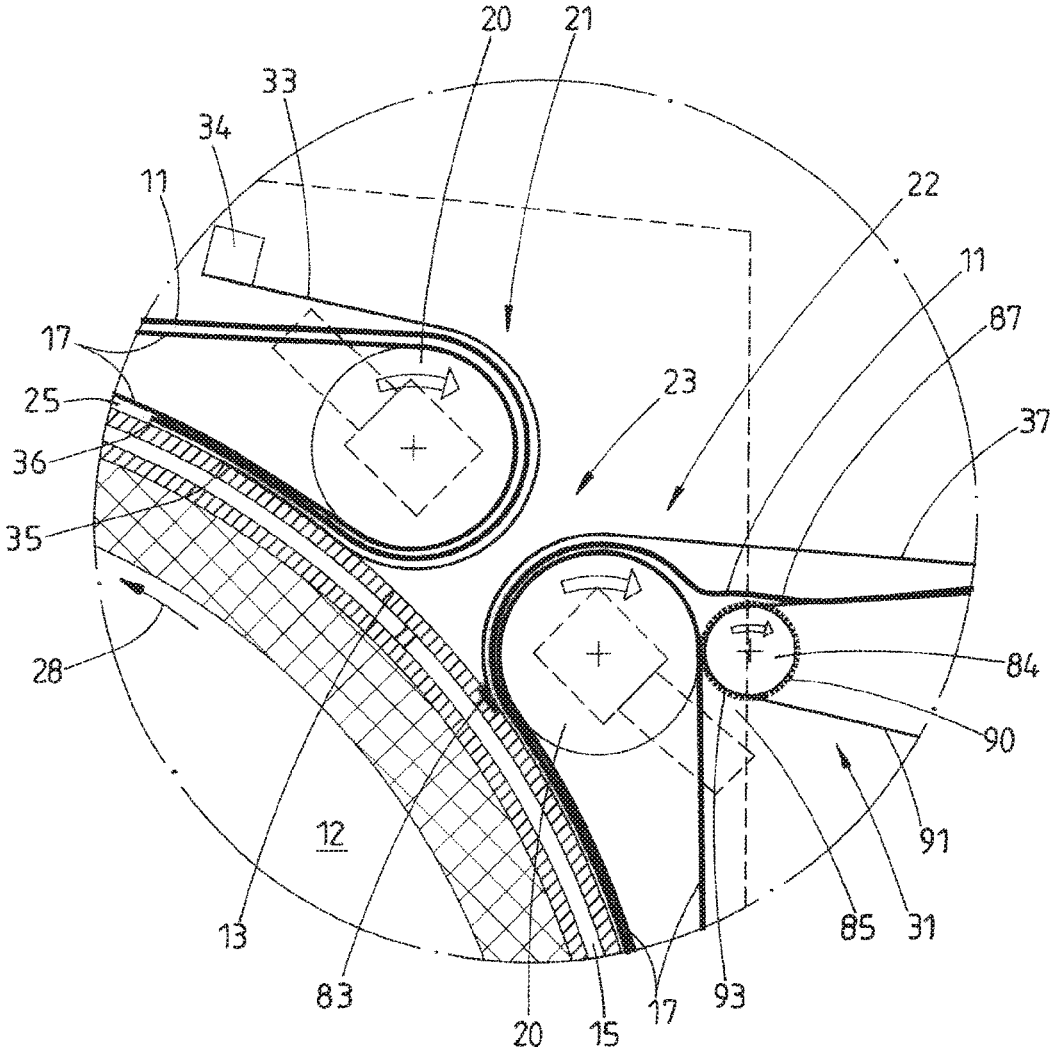
FIG. 4 shows the detail of FIG. 2 for a further alternative exemplary embodiment.

The Figures show various devices realized as band ironers for smoothing out laundry items 11, only one of which is shown in FIGS. 2 to 4. The band ironers can be used in industrial laundries, but also in the domestic sector. The laundry items 11 can be both flat items, for example table linen or bed linen, but also garments, for example clothing.

Figure 1:
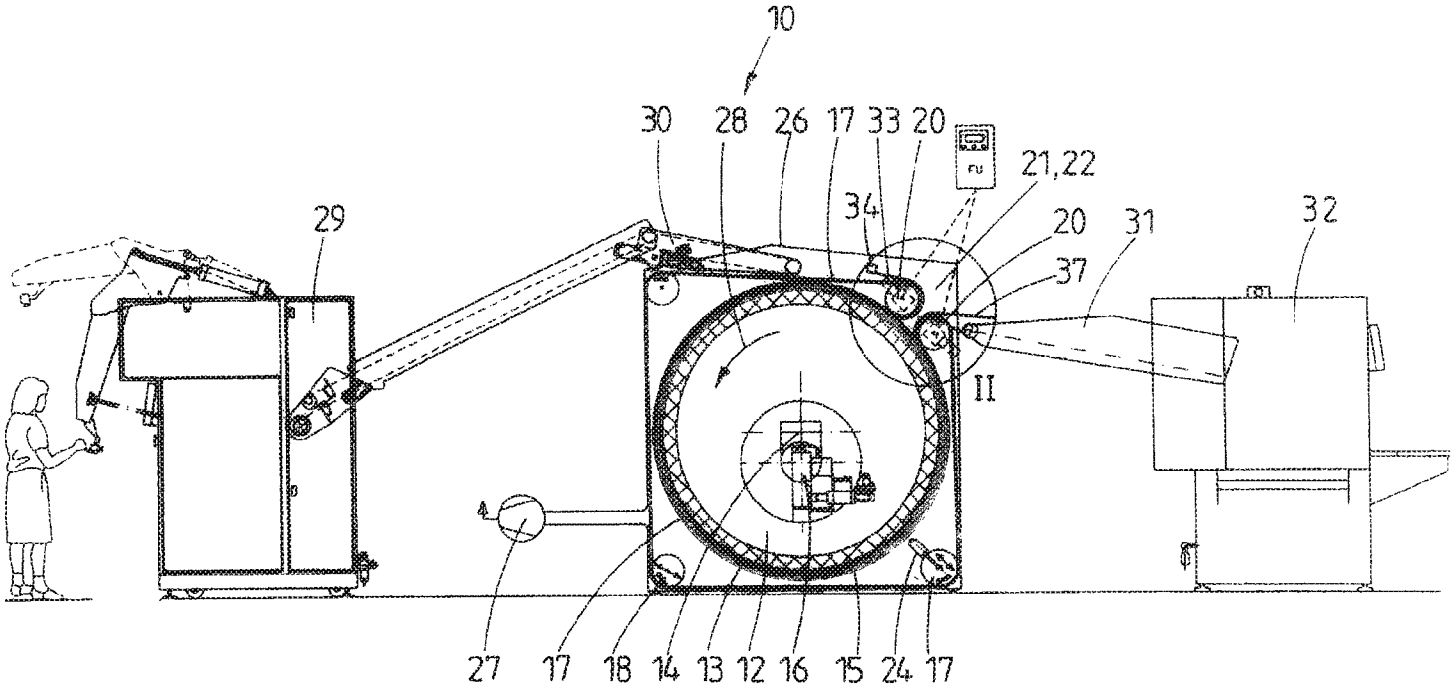
FIG. 1 shows a schematic side view of a device for ironing laundry items, said device being realized as a band ironer.

The band ironer 10 shown in FIGS. 1 and 2 comprises a single, closed ironer body. Said ironer body is realized as a cylindrical ironer roller 12. A cylindrical lateral surface 13 of the ironer body 12 forms a pressing surface. The ironer roller 12 of said exemplary embodiment is rotatingly drivable permanently or at least when required. The ironer roller 12 rotates then about a centric longitudinal centre axis 14.

The wall surface 13 of the ironer roller 12 shown is realized in a double-walled manner. An outer wall is formed by an outer cylinder, on the outside surface of which the pressing surface is situated. An inner cylinder, which has a smaller diameter, forms the second wall of the ironer roller 12. Between the outer and the smaller inner cylinder, there is thus a circumferential, ring-like cavity 15 in the ironer roller 12, through which runs a heat carrier medium, preferably thermal oil in the exemplary embodiment shown, serving for heating the lateral surface 13 and consequently the pressing surface. Instead of the circumferential cavity 15, however, several flow channels for the heat carrier medium can also be arranged in the interior of the ironer roller 12. For example, such flow channels can be formed by so-called cushion plates. In this case, the flow channels are situated on the inside surface of the cylindrical lateral surface 13, defined by a profiled inner metal sheet. The thermal oil can be heated by means of a thermal heater 16 which is arranged in the exemplary embodiment shown in the interior of the ironer roller 12.

The band ironer 10 shown additionally has an endless ironer band 17 which preferably extends over the entire width of the ironer roller 12. The ironer band 17 is associated with the outside of the ironer roller 12. The ironer band 17, in this case, is guided around a large part of the outside circumference of the lateral surface 13 of the ironer roller 12, preferably around between 250° and 350°. As a result, a large part of the lateral surface 13 of the ironer roller 12 which serves as a pressing surface is wrapped around by the endless ironer band 17.

The ironer band 17 in the case of the band ironer 10 shown here is guided around five guide drums 18, 19, 20. One guide drum 20 which is arranged for instance next to the topmost position of the ironer roller 12 forms an inlet region 21 of the band ironer 10. A second guide drum 20 which is arranged at a small spacing away from the guide drum 20 at the inlet region 21 forms an outlet region 22 of the band ironer 10. Said guide drum 20 is arranged a little lower than the guide drum 20 in the inlet region 21. As a result of a spacing between the two adjacent parallel guide drums 20 at the inlet region 21 and at the outlet region 22, a narrow gap 23 is created between the same. Both guide drums 20 are preferably driven or drivable. The synchronous operation is produced by a frequency inverter circuit of its electric motors which serve for providing the drive. The guide drums 18 and 19 are not driven, that is to say they are freely rotatable about their longitudinal centre axis. Whilst the guide drums 18 and 20 are arranged in a stationary manner, the guide drum 19 is mobile such that parallel displacement of its longitudinal centre or rotational axis by means of, for example, pressure cylinders 24 at oppositely situated ends of the guide drum 19 is possible. As a result, the endless ironer gap 17 is tensionable.

The three guide drums 18 and 19 are arranged in three corner regions of a square. In contrast, the two guide drums 20 which are grouped to form a pair are arranged close to a fourth corner of the square; they do not close the square, however, due to the gap 23 formed between the guide drums 20.

The length of the ironer band 17 is dimensioned such that, on the one hand, it wraps around the ironer roller 12 from the outside from the guide drum 20 at the inlet region 21 up to the guide drum 20 at the outlet region 22 by around between 250° and 350° and, on the other hand, runs around an approximately square-shaped track on the outside of the ironer roller 12. The empty run or the return run of the ironer band 17, which at the moment is not coming into contact with the laundry item 11, is moved along said square-shaped track without contacting the ironer roller 12. The other part of the ironer band 17, which wraps around a majority of the ironer roller 12, is formed by an operating run which conveys the respective laundry item 10 by entrainment along the lateral surface 13 of the ironer roller 12 which serves as the pressing surface, the laundry item 11 sliding along the pressing surface. The laundry item 11 to be ironed in each case being located, in this case, in an ironer gap 25 between the ironer band 17 and the lateral surface 13 of the ironer roller 12.

The empty run of the ironer band 17, which is guided approximately along a square, is surrounded on the outside by a box-shaped housing of the band ironer 10. A suction pipe with a suction fan 27 is guided out of the housing 26, as a result of which hot exhaust air can be sucked up out the interior of the band ironer 10. Where applicable, the exhaust air can be prepared by removing energy from it, for example by means of a heat exchanger, which energy is able to be re-used somewhere else in particular in a laundry.

In a particular manner, the rotating drive is realized on the ironer roller 12 and is preferably matched to the drive for the circumferential ironer band 17. At least the rotational speed of the drive of the ironer roller 12 is preferably steplessly adjustable. Where required, said drive can also be completely stopped such that the ironer roller 12 is then not rotatingly driven. It is also conceivable to drive the ironer roller 12 at a constant rotational speed and to adjust the drive of the ironer band 17 preferably in a stepless manner such that the circumferential speed of the ironer band 17 is adjustable. It is also possible to adjust both the rotational speed of the ironer roller 12 and the circumferential speed of the ironer band 17. Accordingly, at least one drive of the ironer roller 12 or of the ironer band 17 is realized as an adjustment drive preferably with an infinitely variable rotational speed. Where applicable, the two drives can also be realized as adjustment drives.

The method according to the invention is realized by adjusting the rotational speed of the ironer roller 12 and/or the circumferential speed of the ironer band 17. Accordingly, the speeds are adjustable in such a manner that the slip, which is produced as a result of a different circumferential speed of the ironer roller 12 and a different circumferential speed of the ironer band 17, is adjustable, namely is able to be increased or reduced. For example, slip produced where the circumferential speed of the ironer roller 12 is faster compared to the circumferential speed of the ironer band 17, is reduced by reducing the rotational speed of the ironer roller 12. Where the circumferential speed of the ironer band 17 is faster in relation to the circumferential speed of the ironer roller 12, the slip is reduced by increasing the rotational speed of the ironer roller 12. The procedure is analogous when the ironer roller 12 is driven at a constant rotational speed and the circumferential speed of the ironer band 17 is adjusted instead. With the ironer band 17 running faster, the slip is then reduced by reducing the circumferential speed of the ironer band 17. When both the rotational speed of the ironer roller 12 and the circumferential speed of the ironer band 17 are adjustable, the slip can be reduced or increased by adjusting the rotational speed of the ironer roller 12 and/or the circumferential speed of the ironer band 17. In all the cases described previously, the slip is able to be eliminated completely, where necessary, by synchronizing the circumferential speed of the ironer roller 12 and the circumferential speed of the ironer band 17.

By adjusting or eliminating the slip of the laundry item 11 in relation to the pressing surface of the ironer roller 12, the surface of the laundry item 11 sliding due to the slip along the pressing surface of the ironer roller 12 and consequently the finish on the laundry item 11 can be adjusted corresponding to the requirements. If no slip is provided, identical surface conditions and consequently an identical finish or absolutely no finish are set on both sides when smoothing out the laundry item 11. If, in contrast, slip is present, the surface of the laundry item 11 sliding along the pressing surface receives a finish. This is adjustable by increasing or reducing the slip by correspondingly adjusting the speed differential between the ironer roller 12 or its pressing surface and the ironer band.

The ironer band 17 is realized for the reliable, non-positive, in particular frictional entrainment of the laundry item 11 such that it conveys the laundry item 11 in the ironing direction 28 through the ironer gap 25. To this end, at least the side of the ironer band 17 which abuts against the laundry item 11 is provided with a surface that comprises adhering properties and is preferably structured and/or rough. The lateral surface 13 of the ironer roller 12 which serves as the pressing surface, in contrast, is realized in a non-adhering manner such that the laundry item 11, due to the slip which is present in the usual case between the laundry item 11 and the lateral surface 13 of the ironer roller 12, is easily able to slide along the pressing surface. In a preferred manner, such a smooth and non-adhering pressing surface is created by an outer coating on the lateral surface 13 of the ironer roller 12. Said coating can be formed from Teflon® brand of polymer or another plastics material comprising good sliding properties, from ceramic or also from chromium-plate. Such coatings are distinguished by the high level of wear resistance and are very smooth such that due to the slip on the pressing surface, the finish on the side of the laundry item 11 abutting against the ironer roller 12 is created. As a result of the non-adhering properties of the smooth pressing surface, an increase in the pressing surface which would otherwise be necessary during ironing is not needed.

In the embodiment shown, each laundry item 11 is deposited by a feed conveyor 30 of an input machine 29 on the empty run of the ironer band 17, which runs over the ironer roller 12, in front of the inlet region 21 of the band ironer 10. From the outlet region 22, the ironed laundry item 11 passes, for example, onto an input conveyor 31 of a folding machine 32 and is conveyed elsewhere thereon.

So that in the inlet region 21 the laundry item 11 passes distortion-free and/or crease-free into the ironer gap 25, a feeding aid from the outside is associated with the ironer band 17 in the inlet region 21. In the exemplary embodiment shown, the feeding aid is realized as a soft, pliable material strip 33 with good sliding properties (similar to the pressing surface of the ironer roller 12). When viewed in the ironing direction 28 or circumferential direction of the ironer band 17, said material strip 33 is fixed on a stationary holding bar 34 with its front transverse edge in front of the guide drum 20 in the inlet region 21. The holding bar 34 is positioned somewhat above the ironer band 17 for forming an inlet funnel for the laundry item 11 which has been placed onto the ironer band 17 by the feed conveyor 30. The material strip 33 extends from the holding bar 34 around approximately half the circumference of the guide drum 20 up to into the ironer gap 25. A rear transverse edge 35 of the material strip 33 ends just behind the guide drum 20 in the initial region of the ironer gap 25 (FIG. 2). The material strip 33, which is smooth at least on the surface and is formed, for example, from a thin web or film produced from Teflon, is entrained in the ironing direction 28—as long as there are not any laundry item 11 situated in the inlet region 21—by the ironer band 17, due to the adhering properties of the same, and in this case, clings to the ironer band 17 from the outside in the inlet region 21. The laundry item 11 to be input into the band ironer 10 passes with its leading front edge 36 into the funnel-shaped inlet gap between the material strip 33 and the ironer band 17. On account of the material strip 33 following thereafter and clinging to the ironer band 17, the laundry item 11, as it continues to approach the inlet region 21, is enclosed in a sandwich-like manner between the material strip 33 and the ironer band 17 and, entrained by the ironer band 17, is fed to the ironer gap 25 in the inlet region 21. Because the material strip 33 ends in the initial region of the ironer gap 25, the overlapping of the laundry item by the material strip 33 is eliminated here such that as the ironer gap 25 develops, the laundry item 11 passes between the ironer band 17 and the pressing surface formed by the lateral surface 13 of the ironer roller 12 (FIG. 2).

In the present exemplary, embodiment the outlet region 22 of the band ironer 10 has associated therewith a discharging means. This is also formed from a material strip 37. The discharging means does not necessarily have to be flexible such that a thin metal strip, that is to say a discharge plate, can be provided instead of the material strip 37.

The material strip 37 forming the discharging aid is fixedly connected at its transverse edge 83, which extends parallel to the longitudinal centre axis of the ironer roller 12, to the outer lateral surface of the ironer roller 12 or to another ironer body. As a result, said discharging means is only suitable for band ironers which are provided with a stationary ironer roller 12 or another stationary ironer body. Proceeding from the transverse edge 83, the material strip 37 extends over part of the ironer band 17, which is guided around the guide drum 20, such that the laundry item 11 leaving the outlet region 22 is guided in the outlet region 22 through between the ironer band 17 and the material strip 37 away from the outer lateral surface of the ironer roller 12 to the conveyor which connects directly to the outlet region 22, preferably the input conveyor 31 provided in the exemplary embodiment shown for conveying the ironed laundry item 11 further to the folding machine 32. In the case of the exemplary embodiment shown, the material strip 37 only extends up to the guide drum 84 of the input conveyor 31 which is positioned adjacent the guide drum 20. The guide drum 83 can also be driven where applicable.

In the exemplary embodiment in FIG. 2, a short space 85 between the guide drum 20 in the outlet region 22 and the closely following guide drum 84 of the input conveyor 31 is bridged by means of a further discharging aid. Said discharging aid is formed in the exemplary embodiment in FIG. 2 by a baffle plate 86. The ends of the baffle plate 86, which are arranged in a stationary manner between the guide drums 20 and 84, end as closely as possible in front of the guide drums 20 and 84. The baffle plate 86 is associated with the bottom surface of the laundry item 11 which comes into contact with the ironer band 17 such that the laundry item 11 is discharged from the ironer band 17 in the outlet region 22 from the end located close to the guide drum 20 at the tip of the baffle plate 86. The laundry item 11 is then guided along the baffle plate 86 to the guide drum 84 and there onto a top run 87 of the input conveyor 31.

Because, for entrainment by the ironer band 17, the laundry item 11 adheres to the same in a stronger manner than to the smooth cylinder wall of the ironer roller 12, the material strip 37 associated with the exposed top surface of the laundry item 11 can be omitted according to an alternative realization of the invention such that only the baffle plate 86 is provided as the single discharging aid. This applies in particular to band ironers 10 with the rotatingly drivable ironer roller 12 where a material strip 37 which is fixedly connected to the same cannot be realized.

FIG. 3 shows an alternative exemplary embodiment for a discharging aid, associated with the bottom surface of the laundry item 11, in the outlet region 22 of the band ironer 10. Said discharging aid separates the laundry item 11 pneumatically from the ironer band 17 in the outlet region 22. To this end, the discharging aid, in the case of the exemplary embodiment in FIG. 3, is formed by preferably several air nozzles 89 which are preferably arranged in a row extending transversely with respect to the ironing direction 28, preferably uniformly spaced apart from one another. In a preferred manner, the air nozzles 89 are supplied with compressed air. However, it is also conceivable for one or several air nozzles 89 to be formed by at least one blower or to be supplied with air from at least one blower. The air jets of the air nozzles 89 are focussed or directed in a diffused manner onto an upper guide region of the guide drum 20 guiding the ironer band 17 in the outlet region 22, in opposition to the ironing direction 28. As a result, the air jets point against the conveying direction of the laundry item 11. This results in the bottom surface of the laundry item 11 being separated or detached from the side of the ironer band 17 pointing to the same in a particularly efficient manner.

The air nozzles 89 are arranged in the space 85 between the guide drum 20 of the ironer band 17 in the outlet region 22 of the band ironer 10 and the guide drum 84 of the input conveyor 31 which is connected downstream of the guide drum 20 of the band ironer 10. As a result, if the laundry item 11 is not detached from the ironer band 17, an air cushion is also created in the space 85 by the air emerging from the air nozzles 89 and said air cushion carries, as it were, the respective laundry item 11 in the region of the space 85 and, as a result, the ironed laundry item 11 makes a flowing transition from the ironer band 17 to the top run 87 of the input conveyor 31.

Also in the case of the embodiment of the invention shown in FIG. 3, it is possible for the flexible material strip 37 associated with the outer exposed side of the laundry item 10 to be omitted such that in the outlet region 22 only the pneumatic discharging aid associated with the bottom surface of the laundry item 11 abutting against the ironer band 17 is provided, preferably produced from a row of several air nozzles 89.

Figure 5:
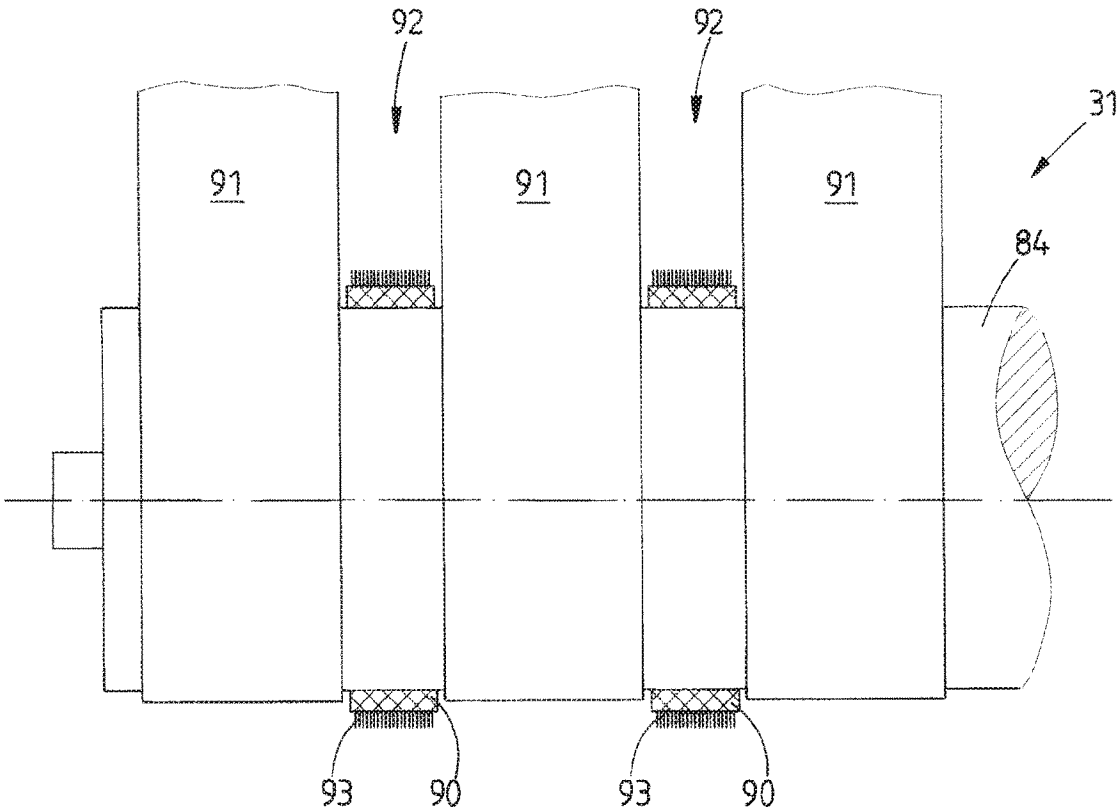
FIG. 5 shows a view of the left-hand part of a guide drum of an input conveyor with horizontally sectioned brush rings in the centre.

FIGS. 4 and 5 show a further exemplary embodiment of a discharging aid associated with the bottom surface of the laundry item 11 coming into contact with the ironer band 17. Said discharging aid operates mechanically with bristles 93. In the outlet region 22 of the band ironer 10, the bristles 93 cooperate on the outside with the bottom surface of the ironer band 17 entraining the laundry item 11 through the ironer gap 25, at the point where the laundry item 11 is to be transferred from the ironer band 17 for removal onto a subsequent conveyor, in the exemplary embodiment shown the input conveyor 31 of the folding machine 32. At the same time the bristles 93 of the discharging aid convey the laundry item 11, which is located thereon and has been separated from the ironer band 17 in the outlet region 22, further onto the top run 87 of a following conveyor, in particular of the input conveyor 31.

In the exemplary embodiment shown, the bristles 93 are associated with several, preferably identically realized brush rings 90, such that they are directed radially outward. The brush rings 90 are associated with the guide drum 84 of the input conveyor 31 of the folding machine 32 which points to the guide drum 20 of the ironer band 17. They can, however, also be arranged on a guide drum of another conveyor.

According to FIG. 5, the input conveyor 31 comprises several narrow belts 91 which are arranged adjacent one another with a spacing in between. All the belts 91 are preferably identical in width. In the exemplary embodiment, the spacing between in each case two adjacent belts 91 of the input conveyor 31 is in each case the same size, but somewhat smaller than the width of the same-width belts 91. As a result of the spaced belts 91, a space 92, which has in each case a brush ring 90 associated therewith, is created between in each case two belts 91. The respective brush ring 90 is connected in a non-rotatable manner to the outer cylindrical lateral surface of the guide drum 84 such that all the brush rings 90 circulate with the guide drum 84 by being rotatingly driven by the guide drum 84. The brush rings 90, in particular the lengths of the bristles 93 themselves, are dimensioned such that the bristles 93 project with their free end regions beyond the outside surfaces and the top run 87 of the narrow belts 91 guided at the guide drum 84. In this way, the bristles 93 of the brush rings 90 can contact the bottom surface, the side of the laundry item 11 abutting against the ironer band 17, and the lateral surface of the guide drum 20 without at the same time the belts 91 and the guide drum 84 touching the ironer band 17 (FIG. 4).

Figure 6:
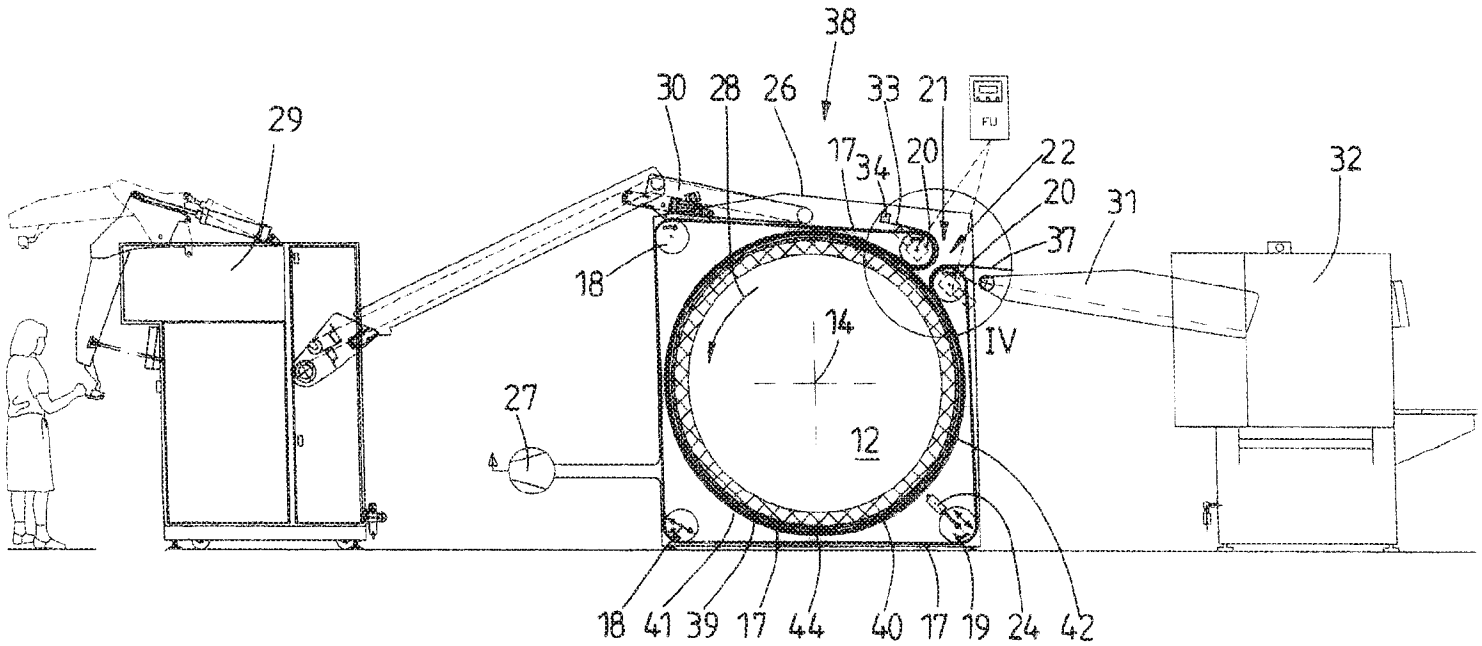
FIG. 6 shows a schematic side view of a second exemplary embodiment of a device realized as a band ironer.
Figure 7:
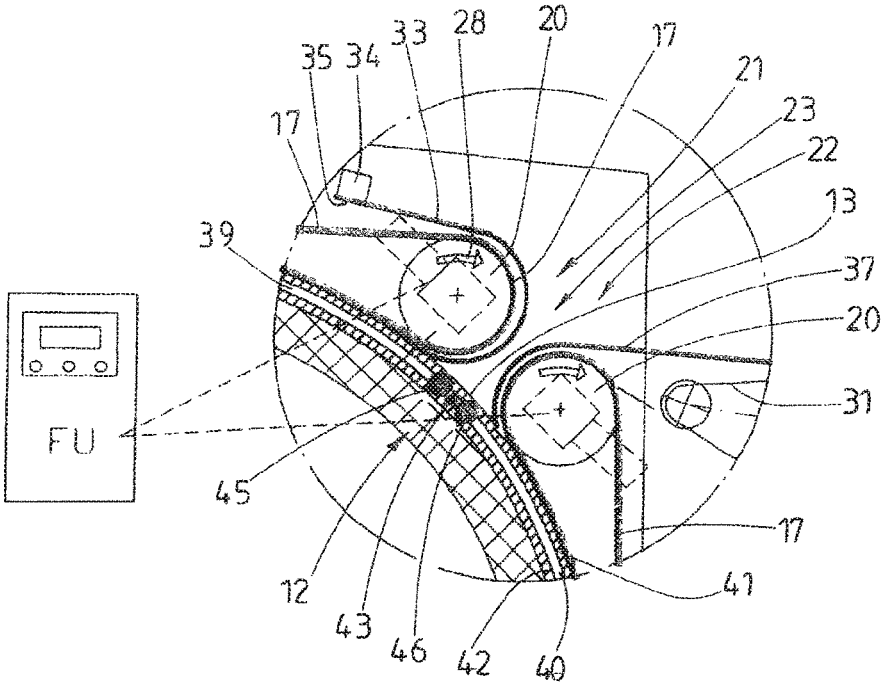
FIG. 7 shows a detail IV from FIG. 6.
Figure 8:
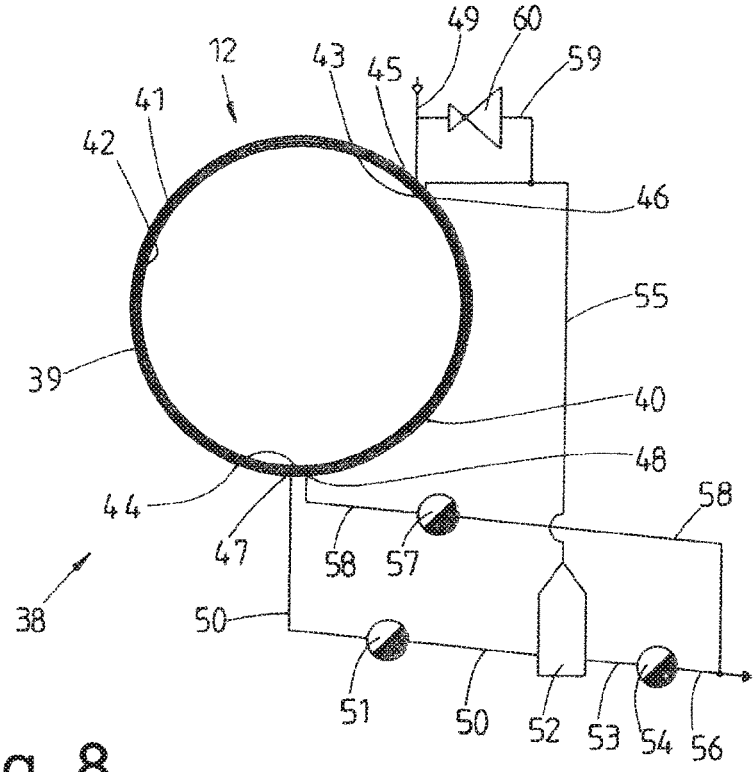
FIG. 8 shows a diagram of the steam piping of the band ironer of FIGS. 6 and 7.

FIGS. 6 to 8 show a band ironer 38 according to a second exemplary embodiment of the invention. Said band ironer 38 is realized in principle in just the same manner as the band ironer 10. Consequently, identical reference numerals are used for identical parts and reference is made to the preceding description of the band ironer 10.

An essential difference between the band ironer 38 and the band ironer 10 is that the ironer roller 12 is not rotatingly drivable, that is to say it is stationary. As a result, slip is generated between the laundry item 11 and the lateral surface 13 of the ironer roller 12, which serves as the pressing surface, when the laundry item 11 is conveyed by the circumferentially driven ironer band 17 through the ironer gap 25. Said slip is only adjustable by means of the circumferential speed of the ironer band 17. The ironer band 17 is realized in just the same manner as in the case of the band ironer 10 and is also guided in just the same way with guide drums 18, 19 and 20. The ironer band 17 has adhering properties for entraining the laundry item 11, whilst just as in the case of the band ironer 10, the lateral surface 13 of the ironer roller 12 is realized in a smooth, in particular non-adherent, manner. The inlet region 21 and the outlet region 22 are also realized in the case of the band ironer 38 in just the same manner as in the case of the band ironer 10. In particular, material strips 33, 37 are also provided in the inlet region 21 and in the outlet region 22 in the case of the band ironer 38 for feeding the laundry item 11 in a reliable crease-free manner at the start of the ironer gap 25 and for removing the ironed laundry item 11 out of the ironer gap 25.

A further difference between the band ironer 38 and the band ironer 10 is that two cavities 39 and 40, which follow one after another in the circumferential direction of the ironer roller 12 or of the ironer body, are formed in the preferably stationary ironer roller 12 or another ironer body, through which cavities a heat carrier medium, steam, is able to flow. Each cavity 39 and 40 extends over part of the circumference of the ironer roller 12 and consequently also over part of the pressing surface. As a result, the cavities 39 and 40 are arranged following one after another in the ironing direction 28. Both cavities 39 and 40 together extend over the entire or at least almost the entire circumference of the ironer roller 12 or its lateral surface 13. The cavities 39 and 40 are identical in width and extend namely in each case over the entire width of the ironer roller 12.

The cavities 39 and 40 of the ironer roller 12 are formed by realizing the casing with a double wall. To this end, the ironer roller 12 comprises an outer cylinder wall 41 for forming the lateral surface 13 with the pressing surface and a concentric inner cylinder casing 42. The outside diameter of the inner cylinder casing 42 is smaller than the inside diameter of the outer cylinder casing 41, as a result of which the cavities 39 and 40 are created between the cylinder casings 41 and 42. As a result of being formed from two concentric cylinder casings 41 and 42, the cavities 39 and 40 comprise an identical thickness (when seen in the radial direction of the ironer roller 12) over the entire circumference of the ironer roller 12. The cavities 39 and 40 are separated from one another by continuous, radial partition walls 43, 44. The partition walls 43 and 44 can be formed in various ways, for example as a result of weld seams between two parts which extend in each case over part of the circumference of the ironer roller 12, the partition walls 43, 44 being created by weld seams for joining said parts at their transverse edges which extend parallel to the longitudinal centre axis 14 of the ironer roller 12.

The cavity 39 proceeds from the gap 23 between the guide drums 20, that is to say the start of the inlet region 21. The cavity 39 extends over more than half the circumference of the ironer roller 12, in the exemplary embodiment shown over between approximately 220° and 230°. In contrast, the smaller or shorter cavity 40 extends over a remaining circumferential region of between approximately 130° and 140°. The cavities 39 and 40 are separated from the partition wall 44 at the lowest point of the ironer roller 12 and directly adjoin one another here. The cavity 40 ends in the outlet region 22 where it is separated from the cavity 39 by the partition wall 43. As a result, the cavities 39 and 40 also directly adjoin one another in the inlet region 21 and outlet region 22, that is to say in the gap 25 between the guide drums 20.

At the point where the cavities 39 and 40 meet one another in the inlet region 21 or outlet region 22, each cavity 39 and 40 comprises in each case at least one preferably lateral feed connection 45, 46 for the steam feed. At the point where the cavities 39, 40 meet at the lowest point of the ironer roller 12, each cavity 39, 40 has associated therewith at least one lateral outlet connection 47 or 48.

FIG. 8 shows a schematic representation of a piping diagram for the steam feed to the ironer roller 12 and the steam removal. The ironer roller 12 with the cavities 39 and 40 and the feed connections 45, 46 and the outlet connections 47, 48 are shown symbolically. By means of a feed pipe 49, live steam, in particular saturated steam or hot steam, coming from a steam generator is guided by means of the feed connection 45 approximately to the topmost point of the longer cavity 39. Once the live steam has traversed the cavity 39 and in so doing has cooled down, the cooled live steam is directed via a discharge pipe 50 to a condensate separator 51 and from there further to a condensate flash trap 52. An outflow pipe 53 leads from the bottom region of the condensate flash trap 52 to a further condensate separator 54 and from there through a discharge pipe 56 to a drain.

In the condensate flash trap 52, the cooled live steam originating from the first cavity 39 is re-evaporated. Expanded steam, which in technical jargon is also designated as flash steam, is generated in this case. Said flash steam emerges at the top out of the condensate flash trap 52 and is fed to the ironer roller 12 again by means of a feed pipe 55, to the feed connection 46 at the start of the second cavity 40 in the outlet region 22. At the bottom end of the second cavity 40, cooled flash steam emerges through the outlet connection 48 out of the ironer roller 12. Said cooled flash steam is fed to a further condensate flash trap 57 by means of a discharge pipe 58. From said condensate flash trap, the condensate, where applicable with residual steam, is directed via a discharge pipe 58 to the discharge pipe 56 leading to the drain or directly to the drain.

In the exemplary embodiment shown, the feed pipe 49 for live steam has associated therewith a bypass pipe 59 which opens out in the feed pipe 55 for flash steam or expanded steam to the cavity 40 or is guided directly to the feed connection 46 of the cavity 40. In the bypass pipe 59 there is a stop valve, preferably a pressure-reducing valve 60, by way of which, if required, live steam can be mixed with the flash steam, at a reduced pressure, when the valve is realized, as in the exemplary embodiment shown (FIG. 8), as a pressure-reducing valve 60.

Due to the cavities 39 and 40 being arranged one behind another in the ironing direction 28, in the case of the band ironer 38 the pressing surface of the ironer roller 12 is heated with steam with a variable energy content. A region of the pressing surface proceeding from the inlet region 21 is heated with live steam, preferably saturated steam or hot steam, which includes more energy. This is advantageous because the laundry items 11 entering the ironer gap 25 are still moist and the elimination of at least a large part of said residual moisture requires more energy than in the end region of the ironer gap 25 where the laundry items 11 are almost dry. Consequently, it suffices when in the cavity 40 associated with the rear part region of the pressing surface, steam with less energy, in particular a smaller energy density, is used to heat the pressing surface. By an initial part of the pressing path of the laundry items 11 through the ironer gap 25 being heated with steam with a greater energy density than a subsequent, preferably residual, part of the pressing path, the residual energy in the live steam, which has cooled on leaving the cavity 39 and is condensed in part, is still able to be used to heat the ironer roller 12 by, once the condensation has been removed and expanded, the expanded or flash steam generated being directed into the rear cavity 40 and there heating the pressing surface sufficiently in the rear part of the pressing path.

Devices for operating the band ironer 10 or 38 can be provided in the interior of the ironer roller 12, for example a condensate heat exchanger or the like.

The live steam traversing the cavity 39 preferably comprises a pressure of in excess of 10 bar. In contrast, the flash steam fed to the cavity 40 has a pressure of less than 10 bar.

The band ironers 10 and 38 are shown in each case only with one single ironer roller 12. Such an ironer roller can have a diameter of between 400 mm and 2.200 mm, depending of the desired performance and intended use of the band ironer. It is also conceivable to form band ironers from two or more than two consecutive and preferably identical ironer rollers 12. These can be driven circumferentially as in the case of the band ironer 10, preferably at an adjustable rotational speed or can also be stationary in accordance with the band ironer 38. The heating of the individual consecutive ironer rollers 12 of such band ironers can be effected in just the same manner as for the band ironers 10 and 38. In the case of band ironers with several consecutive ironer rollers 12, it can be provided that just one single cavity 15 is provided in each ironer roller 12 for heating the steam. The entire pressing surface of the first ironer roller 12 is then heated with live steam and the expanded steam formed therefrom, preferably flash steam, is used to heat the pressing surface of the following ironer roller 12. The inlet region 21 and the outlet region 22 in the case of band ironers with several consecutive ironer rollers can also be realized in just the same way as for the band ironers 10 and 38.

Finally, it is conceivable to provide the band ironers 38 instead of with at least one stationary ironer roller 12 with other ironer bodies, for example non-round ironer bodies such as ironer bodies with oval, elliptical or similar cross sections, where applicable even asymmetrical cross sections.

Figure 9:
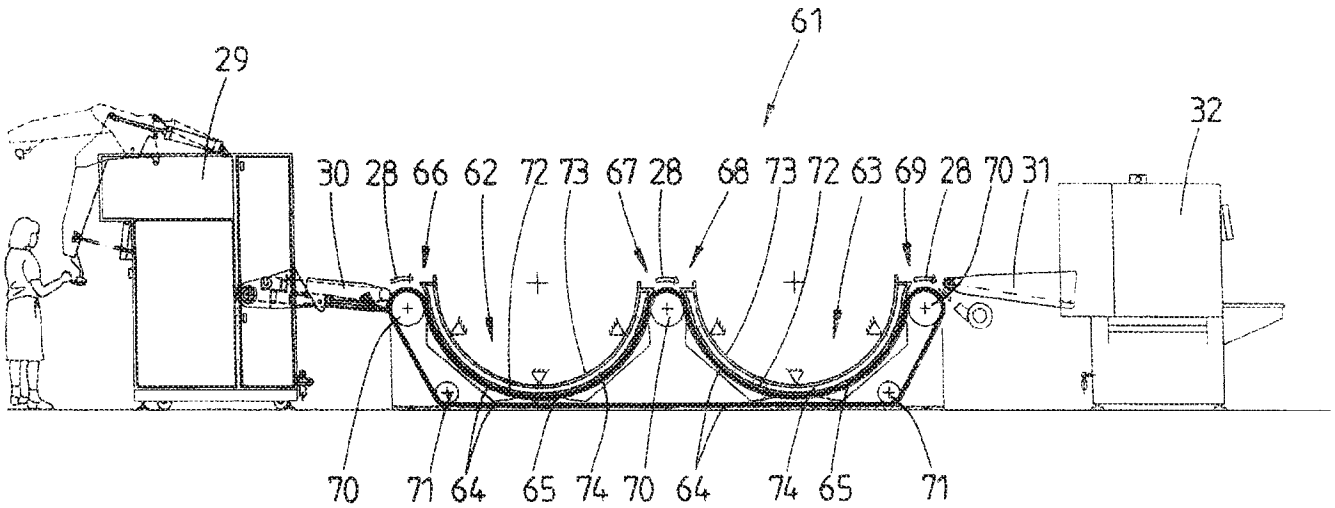
FIG. 9 shows a schematic side view of a third exemplary embodiment of a device realized as a band ironer.

FIG. 9 shows a further exemplary embodiment of a band ironer 61. The ironing principle of said band ironer 61 is the same or at least similar to that of the band ironer 38. The band ironer 61 has two trough-like ironer bodies 62 and 63 which follow one another in the ironing direction 28. The ironer bodies 62 and 63 are realized as two shells which are curved in the manner of a semicircle and in the exemplary embodiment shown are approximately the same size. In a preferred manner, the radius of each ironer body 62 and 63 is between 200 mm and 1.500 mm. The ironer bodies 62 and 63 are stationary like the ironer roller 12 of the band ironer 38 by being arranged in a stationary manner in a framework of the band ironer 61.

The two consecutive ironer bodies 62 and 63 have associated therewith one single continuous ironer band 64 which is endless over the entire width of each ironer body 62 and 63. The ironer band 64 is circumferentially drivable as in the case of the band ironers 10 and 38 described previously. In this case, the endless ironer band 64 entrains the respective laundry item 11 in the ironing direction 28. This is also achieved in the case of said band ironer 61 by means of an adherent outside surface of the ironer band 64 which points to the laundry item 11, by the side or surface of the ironer band 14 coming into contact with the laundry item 11 being roughened and made adherent in another manner. An upper run of the ironer band 64, which conveys the laundry item 11 through the ironer gap 25 of each semi-circular ironer body 62 and 63, has associated therewith an outside surface of both ironer bodies 62 and 63 which points downward and extends in a convex-trough-like manner. The ironer band 64 runs along one after the other under the semi-circular bottom surface of the first ironer body 62 and then under that of the second ironer body 63 following thereafter entraining the respective laundry item 11. Two consecutive, semi-circular ironer gaps 65 are formed in this way between the ironer band 64 and the respective ironer body 62. An empty bottom run of the ironer band 64 runs back under the top run of the ironer band 64 which is formed in the manner of a double semicircle by the two ironer bodies 62 and 63.

An inlet region 66 of the band ironer 61 is situated at a front transverse edge of the first ironer body 62 where the respective laundry item 11 enters the ironer gap 65 of the first ironer body 62 when viewed in the ironing direction 28. An outlet region 67 is situated at the end of the first ironer body 62. An inlet region 68 for the second semi-circular ironer body 63 is formed at a small spacing behind this. An outlet region 69, at which the ironed laundry item 11 leaves the last ironer body 63 and consequently the band ironer 61 in order to be supplied, for example, to the input conveyor 31 of a folding machine 32, is formed at the end of the second ironer body 63.

The inlet regions 66 and 68 of both ironer bodies 62 and 63 and also the outlet regions 67, 69 of both ironer bodies 62 and 63 can have associated therewith material strips 33 or 37 which are not shown in FIG. 9. The material strips are arranged and realized in just the same manner as in the case of the band ironers 10 and 38. The material strips at the outlet region 67 of the first ironer body 62 and of the inlet region 68 of the second ironer body 63 direct the laundry item 11 reliably from the first ironer body 62 to the second ironer body 63 following thereafter.

The single ironer band 64 of the band ironer 61 is guided about three top guide drums 70 and two bottom guide drums 71 in the exemplary embodiment shown. At least one of the guide drums 70 or 71 is rotatingly drivable, preferably the first or last top guide drum 70. However, it is also conceivable to drive the first and the last top guide drums 70 in a synchronously rotating manner, the synchronous operation being produced by a frequency inverter circuit (not shown). The two bottom guide drums 71 and preferably also the middle top guide drum 70 are not driven and are consequently freely rotatable. One of the bottom guide drums 71 can be transversely displaceable and as a result can serve as a tensioning device for the ironer band 64.

Each of the identically realized, semi-circular ironer bodies 62 and 63 of the band ironer 61 is realized in a hollow manner and has a semi-circular cavity 74 namely between two spaced apart, semi-circular plates. The outer plate 72 of each ironer body 62 and 63 forms a semi-circular pressing surface along which the laundry item 11, entrained by the circumferentially driven ironer band 64, is slidingly movable. For this purpose, the pressing surface of the outer plate 72 of each ironer body 62 and 63 coming into contact with the respective laundry item 11 is provided with a wear-resistant anti-stick coating which can be formed in the same manner as in the case of the lateral surface 13 of the ironer roller 12 of the previously described exemplary embodiments. The cavity 74 of each ironer body 62 and 63 is traversable by a heat carrier, for example a thermal oil or steam, as a result of which each ironer body 62, 63 is heated, in particular the pressing surfaces formed by the outer plates 72.

Insofar as the band ironer 61, like the band ironer 38, is heated with steam, live steam, that is to say hot steam or saturated steam, can be directed through the cavity 74 of the first ironer body 62. The cooled live steam leaving the first ironer body 62 is, after preparation, preferably condensate separation and expansion, fed as expanded or flash steam to the cavity 74 in the second ironer body 62 in order to heat said cavity also, above all its outer plate 72 which forms the pressing surface. The feeding of both the live steam and the expanded flash steam is preferably effected at both top transverse edges of each ironer body 62 and 63. The removal of cooled live steam and of the flash steam is effected at the lowest position of each semi-circular ironer body 62, 63, namely approximately in the centre. Guiding and preparing the steam can be effected in exactly the same manner as shown in FIG. 8 in conjunction with the band ironer 38. Reference is made to the associated description.

It is also conceivable to form two consecutive cavities in each semi-circular ironer body 62, 63 like in the case of the band ironer 38, said cavities being supplied with steam with different energy densities, preferably on the one hand live steam and on the other hand flash steam in order to heat, in each case, part of the pressing surface of each ironer body 62, 63.

The ironer bands 17 and 64 are realized in a structured manner at least on the side coming into contact with the laundry items 11. Said sides consequently form an adhering surface and/or a friction surface for the laundry items 11 to be entrained in a slip-free manner by the circumferentially driven ironer bands 17 and 64, the laundry items 11 sliding along the smooth pressing surface of the ironer roller 12 or of the ironer bodies 62, 63 or slip being generated between the ironer bodies 62, 63 and the laundry items 11.

The structuring of the sides of the ironer bands 17, 64 which come into contact with the laundry items 11 can be effected in various ways. In a preferred manner, it is provided that at least the surfaces of the ironer bands 17, 64 coming into contact with the laundry items 11 are realized in a rough manner or are roughened. The roughness or roughening is effected in such a manner that the coefficient of friction of the side coming into contact with the laundry items is greater than that of the laundry items 11 to be entrained. As a result, no slip is generated between the respective ironer band 17, 64 and the laundry items 11 when they are conveyed along the smooth pressing surface of the stationary ironer body or the ironer body which is driven at a speed deviating from the circumferential speed of the ironer bands 17, 64.

The ironer bands 17, 64 can be realized with one layer but also with multiple layers. In the case of multiple-layer ironer bands 17, 64, the layer which comes into contact with the laundry items 11 is realized as an adhering layer or a friction layer.

At least the adhering or friction layer of the respective ironer band 17, 64 is formed from a felt, preferably a coarsely structured felt or a needle felt. The felt or needle felt consists in a preferred manner of a heat-resistant or high-temperature-resistant material. For example, these can be synthetic fibres, for example aramid, glass fibres, carbon fibres or mixtures of such fibres. Also conceivable is forming the adhering layer or friction layer at least in part from natural fibres which have good thermal resistance or are treated in a corresponding manner.

The ironer bands 17, 64 can comprise one layer which has a high tensile strength or comprises reinforcements to increase the tensile strength. However, it is also conceivable to provide the ironer bands 17, 64 with reinforcements. The reinforcements are at least longitudinal stiffenings, but where applicable also transverse stiffenings which cross them. Said stiffenings, produced from, for example, high-tensile-strength, continuous fibres or strands, are preferably embedded in the material of the ironer bands 17, 64.

Figure 10:
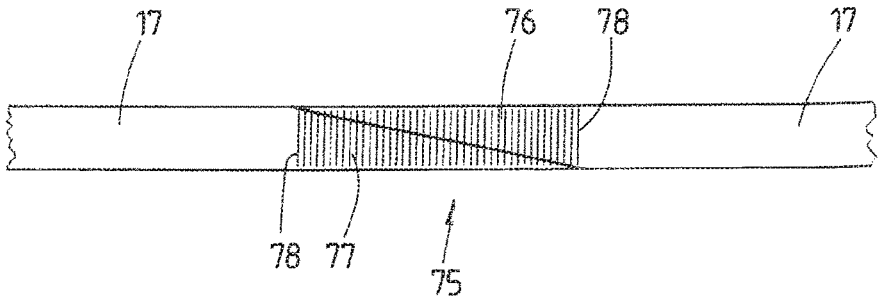
FIG. 10 shows a side view of a first development option of a join in an ironer band and FIG. 11 shows a side view of a second development option of the join in the ironer band.
Figure 11:
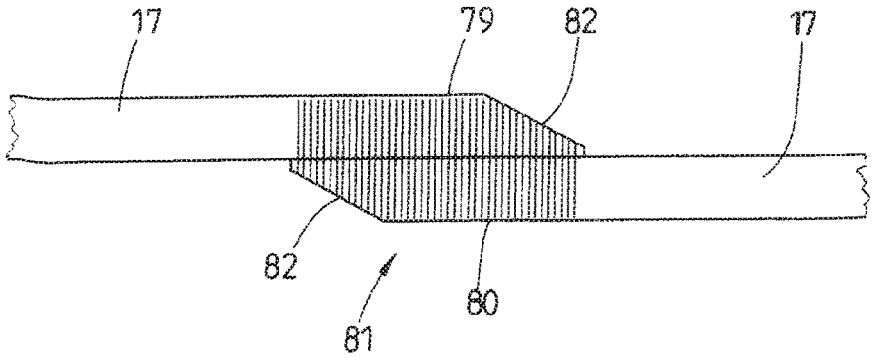

FIGS. 10 and 11 illustrate alternative options for making the ironer bands 17, 64 endless. Said options are explained below by way of the ironer band 17.

In the case of the exemplary embodiment in FIG. 10, narrow end regions of the two ends of the ironer band 17 are connected by a splice and, as a result, the ironer band 17 is made endless in a flush manner. For this purpose, the two ends 76, 77 of the ironer band 17 are chamfered on one side, that is to say brought to a point as it were. When seen from the side, as a result the ends 76 and 77 likewise are triangular in shape. The chamfering is effected in such a manner that the enclosed acute angle between the oblique side and the non-chamfered side in the region of the splice 75 encloses an angle of between approximately 10° and 15°. As a result, the chamfering is approximately 3 to 5 times as long as the thickness of the ironer band 17. When the chamfered ends 76, 77 of the ironer band 17 are joined together, there is a flush and/or seamless connection in the region of the splice 75. The chamfered, oppositely situated ends 76, 77 of the ironer band 17 are joined in the region of the splice 75 by means of needling, which is indicated symbolically in FIG. 10 by means crosswise needling lines 78. In practice, these are not quite as regular and can also be closer together or further apart from one another. In addition to needling, the chamfered surfaces of the two ends 76, 77 can also be bonded. After needling, which is particularly suitable for ironer bands 17 which are formed at least in part from needle felt or another such felt, the joins of the ends 76, 77 of the ironer band 17 located in the region of the splice 75 are at least as durable as the ironer band 17 outside the splice 75. Furthermore, the join between the ends 76, 77 of the ironer band 17 in the region of the splice 75 is no thicker than in the remaining ironer band 17. As a result of making the ironer band 17 endless in the manner described and shown in FIG. 10, a seamless, quasi invisible and highly durable join is created.

FIG. 11 shows an alternative exemplary embodiment for making the ironer band 17 endless. Here, two end regions 79 and 80 of the ironer band 17 are placed one on top of the other with overlap and are joined together in the overlap region. Said joining is also effected as a result of needling, which is effected perpendicular to the surface of the end regions 79 and 80, and, where applicable, as a result additionally bonding the surfaces of the ironer band 17 which overlap in the end regions 79 and 80. In order to flatten or to blunt the transition in the overlap region 81, the top or bottom corner of the end region 79 and 80 are provided with chamfers 82.

The overlap region 81 is shown in FIG. 11 with approximately twice the thickness of the ironer band 17. In practice, however, the end regions 79 and 80 are pressed together as a result of the needling such that after the needling the join in the overlap region 81 is thinner than twice the thickness of the ironer band 17 such that an approximately seamless join is created between the ends of the ironer band 17 which is made endless.

The features explained and described previously in conjunction with the individual band ironers can be combined together in an arbitrary manner. Thus, the features of certain exemplary embodiments of the band ironers can also apply to other exemplary embodiments of the band ironers or features which have been described in conjunction with one or individual band ironers can also apply to the remaining band ironers without this being mentioned in the preceding description.

LIST OF REFERENCES

10 Band ironer
11 Laundry item
12 Ironer roller
13 Lateral surface
14 Longitudinal centre axis
15 Cavity
16 Thermal oil heater
17 Ironer band
18 Guide drum
19 Guide drum
20 Guide drum
21 Inlet region
22 Outlet region
23 Gap
24 Pressure cylinder

25 Ironer gap
26 Housing
27 Suction blower
28 Ironing direction
29 Input machine
30 Feed conveyor
31 Input conveyor
32 Folding machine
33 Material strip
34 Holding bar
35 Transverse edge
36 Front edge
37 Material strip
38 Band ironer
39 Cavity
40 Cavity
41 Outer cylinder casing
42 Inner cylinder casing
43 Partition wall
44 Partition wall
45 Feed connection
46 Feed connection
47 Outlet connection
48 Outlet connection
49 Feed pipe
50 Discharge pipe
51 Condensate drain
52 Condensate flash trap
53 Discharge pipe
54 Condensate drain
55 Feed pipe
56 Discharge pipe
57 Condensate drain
58 Discharge pipe
59 Bypass pipe
60 Pressure-reducing valve
61 Band ironer
62 Ironer body
63 Ironer body
64 Ironer band
65 Ironer gap
66 Inlet region
67 Outlet region
68 Inlet region
69 Outlet region
70 Top guide drum
71 Bottom guide drum
72 Outer plate
73 Inner plate
74 Cavity
75 Join
76 End
77 End
78 Needling line
79 End region
80 End region
81 Overlapping region
82 Chamfer
83 Transverse edge
84 Guide drum
85 Space
86 Baffle
87 Top run
89 Air nozzle
90 Brush ring
91 Band
92 Space
93 Bristle

What is claimed is:

1. A method for ironing items of laundry (11), wherein:

the laundry items (11) are conveyed through an ironer gap (25) between at least one ironer body and at least one ironer band (17, 64) and a lateral surface of at least one ironer body is heated with steam;

the lateral surface (13) of the at least one ironer body or the lateral surfaces (13) of several consecutive ironer bodies is or are heated with steam with a variable energy content;

part of the lateral surface (13) of at least one ironer body is heated with steam that comprises a greater energy content than at least one other part of the same ironer body; and part of the at least one ironer body proceeding from an inlet region (21) of the laundry items (11) into the ironer gap (25) is heated with steam with a higher energy content than part of said ironer body proceeding from an outlet region (22) of the same ironer body.

2. The method according to claim 1, wherein live steam is used as steam with a higher energy content and expanded live steam is used as steam with a lower energy content.

3. The method according to claim 1, wherein the steam with a higher energy content is removed from the heated first part of the lateral surface (13) of a first ironer body and is subject to re-evaporation, wherein the expanded steam generated at the same time is fed to the other part of the same ironing body.

4. A device for ironing items of laundry (11), said device having at least one ironer body and at least one ironer band (17, 64) which is associated with the at least one ironer body and is circumferentially drivable, wherein the items of laundry (11) are conveyable through an ironer gap (25) between the or the respective ironer body and the ironer band (17, 64) associated with the same, wherein the lateral surface (13) of at least one ironer body, defining the ironer gap (25) on one side, has associated therewith two separate cavities (39, 40), which follow one after the other in the longitudinal direction of the ironer gap (25), for heat carriers for heating the ironer body or, in the case of several consecutive ironer bodies, the cavities of the individual ironer bodies are suppliable with steam with a variable energy content.

5. The device according to claim 4, wherein each cavity (39, 40) comprises at least one feed connection (45, 46) for supplying the heat carrier and at least one outlet connection (47, 48) for discharging the heat carrier, wherein the respective feed connection (45, 46) has associated therewith at least one upper region of the respective ironer body and the respective outlet connection (47, 48) has associated therewith a lower region of the respective ironer body.

6. The device according to claim 4 or 5, wherein an outlet connection (47) of a cavity (39) which is traversed by live steam has associated therewith a pipe which leads to a condensate separator and/or to a steam processing device and the steam processing device has associated therewith a pipe for the supply of expanded steam to the feed connection (46) of another cavity (40).

7. The device according to claim 4, wherein at least one cavity (39) for live steam has associated therewith a cavity (39), proceeding from the inlet region (21; 66, 68), of at least one ironer body and at least one cavity (40) for expanded steam has associated therewith a part, proceeding from the outlet region (22; 67,69), of the at least one ironer body.

8. A device for ironing items of laundry (11), said device having at least one ironer body and at least one ironer band (17, 64) which is associated with the at least one ironer body and is circumferentially drivable, wherein the items of laundry (11) are conveyable through an ironer gap (25) between the or the respective ironer body and the ironer band (17, 64) associated with the same, wherein at least one inlet region (21; 66, 68) of the laundry items (11) into the respective ironer gap (25) has associated therewith a feeding aid, the start of which in front of the inlet region (21; 66, 68) is held at a spacing from the ironer band (17; 64) and the feeding aid projects into the ironer gap (25) by way of a free end located opposite the start.

9. The device according to claim 8, wherein the feeding aid is realized as a soft, flexible material strip (33) with good sliding properties.

10. The device according to claim 8 or 9, wherein a transverse edge (35), which is located closely in front of the inlet region (21; 66, 68) at the start of the material strip (33), is fixed in a non-movable manner above the ironer band (17; 64) to form a feed funnel for feeding the laundry item (11), which is enclosed between the ironer band (17; 64) and the material strip (33), to the start of the ironer gap (25).

11. The device according to claim 8, wherein the feeding aid is realized as a soft, flexible material strip (33) with a surface which does not adhere to the laundry items (11).

12. The device according to claim 11, wherein a discharging aid is associated with a guide drum (20) of the ironer band (17; 64) at the outlet region (22; 67; 69) of the band ironer (10).

13. The device according to claim 11, wherein a discharging aid is realized as at least one non-movable baffle plate (86) which is associated with the guide drum (20) of the ironer band (17; 64) at the outlet region (22; 67; 69) of the band ironer (10).

14. The device according to claim 11, wherein a discharging aid is formed by at least one rotating brush.

15. The device according to claim 14, wherein the at least one brush has associated therewith a drum of a belt conveyor which follows the band ironer (10) in the ironing direction (28), said drum pointing to the outlet region (22; 67; 69) of the band ironer (10).

16. The device according to claim 15, wherein the brushes are realized as brush rings (90) which co-rotate with the drum.

17. The device according to claim 16, wherein the brush rings (90) are arranged in at least some spaces (92) between adjacent narrow belts (91) of the belt conveyor.

18. A device for ironing items of laundry (11), said device having at least one ironer body and at least one ironer band (17, 64) which is associated with the at least one ironer body and is circumferentially drivable, wherein:

the items of laundry (11) are conveyable through an ironer gap (25) between the or the respective ironer body and the ironer band (17, 64) associated with the same;

at least one outlet region (22; 67, 69) of the or of the respective ironer gap (25) has associated therewith at least one discharging aid for laundry items (11) that have been ironed; and at least one discharging aid is realized as a thin-walled, flexible material strip (37) which is fixed at the end of the ironer gap (25) with a front transverse edge on the stationary ironer body for guiding laundry items (11) that have been ironed into the outlet region (22; 67, 69) between the ironer band (17; 64) and the material strip (37).

19. The device according to claim 18, wherein a discharging aid has associated therewith a side of the laundry item (11) which comes into contact with the ironer band (17; 64).

20. The device according to claim 19, wherein the discharging aid is formed by at least one rotating brush.

21. The device according to claim 18, wherein a discharging aid, which is associated with the side of the laundry item (11) which abuts against the ironer band (17; 64), separates the respective laundry item (11) from the ironer band in a pneumatic manner.

22. The device according to claim 21, wherein the discharging aid comprises at least one air nozzle (89) which is supplied with compressed air, the air jet of which is directed against the side of the laundry item (11) that abuts against the ironer band (17; 64).

23. The device according to claim 18, wherein a discharging aid, which is associated with the side of the laundry item (11) which abuts against the ironer band (17; 64), separates the respective laundry item (11) from the ironer band (17; 64) in a mechanical manner.

24. The device according to claim 23, wherein the discharging aid is realized as at least one non-movable baffle plate (86) which is associated with the guide drum (20) of the ironer band (17; 64) at the outlet region (22; 67; 69) of the band ironer (10).

25. The device according to claim 8 or 18, wherein at least one surface of at least one material strip (33, 37) that comes into contact with the laundry item (11) comprises good sliding properties and is non-adhering.

26. The device according to claim 8 or 18, wherein the lateral surface (13) of at least one ironer body which comes into contact with the items of laundry (11) comprises non-adhering properties and the at least one ironer band (17; 64) comprises adhesion properties for entraining the laundry items (11) when they move past the lateral surface (13) of the at least one ironer body.

* * * * *